US008819949B2

(12) United States Patent
Fritsch et al.

(10) Patent No.: US 8,819,949 B2
(45) Date of Patent: Sep. 2, 2014

(54) LINE MARKING ASSEMBLY

(76) Inventors: Keith Gerard Fritsch, Kaukauna, WI (US); Herbert John Peter Goetz, Neenah, WI (US); Mark S Payne, Neenah, WI (US)

( * ) Notice: Subject to any disclaimer, the term of this patent is extended or adjusted under 35 U.S.C. 154(b) by 198 days.

(21) Appl. No.: 13/550,475

(22) Filed: Jul. 16, 2012

(65) Prior Publication Data

US 2013/0019487 A1 Jan. 24, 2013

Related U.S. Application Data

(60) Provisional application No. 61/509,646, filed on Jul. 20, 2011.

(51) Int. Cl.
*B44D 3/38* (2006.01)

(52) U.S. Cl.
USPC ..... 33/414; 33/354

(58) Field of Classification Search
USPC ..... 33/1 LE, 354, 369, 379, 413, 414
See application file for complete search history.

(56) References Cited

U.S. PATENT DOCUMENTS

| | | | | |
|---|---|---|---|---|
| 1,219,473 | A | 3/1917 | Meldrum | |
| 3,126,637 | A | 3/1964 | Short | |
| 4,189,844 | A * | 2/1980 | Riggins, Sr. | 33/414 |
| 4,197,656 | A | 4/1980 | Lane et al. | |
| 4,551,922 | A | 11/1985 | Someya | |
| 4,565,011 | A | 1/1986 | Karger | |
| 4,592,148 | A | 6/1986 | Longenette | |
| 4,765,557 | A | 8/1988 | Kahmann | |
| 5,042,159 | A | 8/1991 | Millen | |
| 5,509,616 | A | 4/1996 | Millen, Jr. | |
| 5,920,997 | A | 7/1999 | Girtman | |
| 6,470,581 | B1 | 10/2002 | Kolodzieski | |
| 7,469,482 | B2 * | 12/2008 | Hickey et al. | 33/414 |
| 7,908,754 | B2 | 3/2011 | Fritsch | |
| 2006/0000099 | A1 * | 1/2006 | Tessel et al. | 33/414 |
| 2006/0096107 | A1 * | 5/2006 | Hickey et al. | 33/414 |
| 2014/0007440 | A1 * | 1/2014 | Cain | 33/413 |

* cited by examiner

*Primary Examiner* — G. Bradley Bennett
(74) *Attorney, Agent, or Firm* — Steven H. Greenfield; Greenfield Invention and Patent Consulting Inc.

(57) ABSTRACT

A line marking assembly for applying a marking a straight line with a marking powder onto a surface is disclosed. The line marking assembly comprises two chambers configured to mount one on each side of a level. Each chamber contains a cord wound on a spool, marking powder and a tensioning assembly that exerts a constant and continuous pull on the cord. The cords from each of the chambers may be combined with a coupler. Moving the coupler back and forth between the chambers coats the cords with marking powder. Placing the assembly onto a surface and snapping the cord marks a straight line on the surface.

12 Claims, 15 Drawing Sheets

LINE MARKING ASSEMBLY

RELATED APPLICATIONS

This application claims priority from provisional application No. 61/509,646 filed on Jul. 20, 2011.

FIELD OF THE INVENTION

The present invention relates to a device for marking a straight line. More specifically, the device comprises a flexible line coated with marking powder, such as chalk or ink which may be white or colored, configured for marking a straight line between two predetermined points on a surface. The device is mounted onto a level to form an assembly which provides a level measuring capability for the surface in addition to marking a straight line. The use of marking powders has the benefit of placing a highly visible mark on the surface.

BACKGROUND OF THE INVENTION

Line marking devices known in the art typically comprise of a spool on which a string is wound under tension. The string is extended through a marking dye reservoir such as chalk or ink and snapped onto the desired location to mark a line. A clip or hook attached to the extending end of the string opposite to the spool may be used for gripping the line when extending it out of the spool and to prevent the end of line from being pulled into the spool when released.

U.S. Pat. No. 4,551,922 provides for a line marking device comprising an extensible pipe assembly, a pair of arm members pivoted to the opposite ends of the pipe assembly, two reels rotatably supported on the pipe assembly between the opposite ends of the pipe assembly, an ink pad assembly mounted on one of the arm members, guide wheels rotatably supported on the arm members, a line marking string anchored at the opposite ends to the reels and guided along the guide wheels and a spirit level mounted on the pipe assembly between one of the arm members and one of the reels.

U.S. Pat. No. 4,765,557 is directed to an automatic retractable chalk snap string device having an improved brake structure for selectively braking the spring-biased hub on which the chalk string is retractably wound.

U.S. Pat. No. 5,042,159 discloses a chalk line retraction device formed of a hollow casing defining a chalk line aperture there through. A chalk line reel carrying a chalk line is mounted for rotation within the casing and is keyed to a spur gear. The spur gear is engaged with a ring gear of much larger pitch diameter.

U.S. Pat. No. 5,920,997 is for an automatically retractable chalk line device having a housing in which a power spring drives a first large diameter gear through a first shaft. The first large diameter gear is in driving engagement with a first smaller diameter gear located below the power spring. The first smaller diameter gear drives a second large diameter gear located partially above the power spring. The second large diameter gear drives a second smaller diameter gear which a drives a chalk retaining spool, which holds the chalk line.

U.S. Pat. No. 6,470,581 describes a dual chalk line marker device having two chalk line spools that are adjustably movable with respect to the housing or base. The spools are adjustable in order to vary the separation width between the chalk lines so that different widths of joist or roofing shingle can be properly marked for disposition upon a work surface.

Embodiments similar to that of the present invention are described in U.S. Pat. No. 7,908,754 for a dual level marking apparatus that enables a single worker to snap a marking line comprised of: a substantially linear housing forming at least one substantially planar surface comprised of a square tubular body, and at least one internal channel parallelly positioned to the substantially linear housing; a reservoir containing a marking material secured to at least one surface of the housing; at least two pulley components parallelly positioned at opposite ends of said housing; at least one tension control component having at least one tension adjustment control adapted to manipulate at least one of said at least two pulley components, at least one horizontal level bubble parallelly positioned within the substantially linear housing; at least one vertical level bubble perpendicularly positioned within the substantially linear housing; a line with no loose ends adapted to receive said marking material secured to each of at least two pulley components as a continuous loop and mounted to move slidably through the reservoir parallel with the housing. In a preferred embodiment, a housing includes at least one internal channel which may be hollow or partially hollow or contain apertures or recesses for depositing one or more marking material reservoir.

In other embodiments, more or fewer spool components may be utilized, and spool components may be of different shapes and configurations, or internally or externally mounted. In the embodiments shown, spool component may further include a pivotal handle which allows the user to rotate the spool component but other embodiments may include functional equivalents such as a knob, lever, protuberance or other structures.

SUMMARY OF THE PRESENT INVENTION

In one aspect of the present invention, a line marking assembly configured for mounting onto a level comprises: a first chamber containing a spool for winding a first cord, the spool contained in the first chamber comprising a tensioning member, wherein an end of the first cord is configured for exiting the first chamber through a first conduit disposed at a front side and at an outer side of the first chamber; a second chamber containing a spool for winding a second cord, the spool contained in the second chamber comprising a tensioning member, wherein an end of the second cord is configured for exiting the second chamber through a second conduit disposed at a front side and at an outer side of the second chamber, the first chamber containing a marking powder and the second chamber containing a marking powder; a first coupling member attached to the end of the first cord, the first cord being configured for exiting the first chamber; and a second coupling member attached to the end of the second cord, the second cord being configured for exiting the second chamber, the first coupling member being configured for attaching to the second coupling member to form an assembled coupler and a combined cord.

In another aspect of the present invention, a method for applying a straight line mark on a surface, the method comprises: providing a line marking assembly configured for mounting onto a level; mounting the first chamber onto a first side of the level and mounting the second chamber on a second side of the level in a manner such that: the outer side of the first chamber is disposed over the front side of the level, the outer side of the second level is disposed over the front side of the level, the second chamber is disposed in a position that is a mirror image of the first chamber and the first and second coupling members are in an un-stretched position; coating the first cord with marking powder by pulling the first coupling member and the end of the first cord that are disposed at the first chamber toward the second coupling member that is disposed at the second chamber; attaching the first coupling member to the second coupling member to form an assembled coupler such that an outstretched cord resulting from attaching the first and second cord is offset from a center of the level and is disposed directly over and substantially parallel with a first side edge of the level to form an installed line marking assembly; placing the front side of the level onto the surface to be marked such that the cord is parallel and adjacent to the line on the surface to be marked; and pulling the cord upward and releasing it onto the surface, the releasing the cord resulting in snapping the outstretched cord onto the surface thereby releasing a portion of the marking powder and forming a straight line mark on the surface.

These and other features, aspects and advantages of the present invention will become better understood with reference to the following drawings, description and claims.

DETAILED DESCRIPTION OF THE INVENTION

Figure 1:
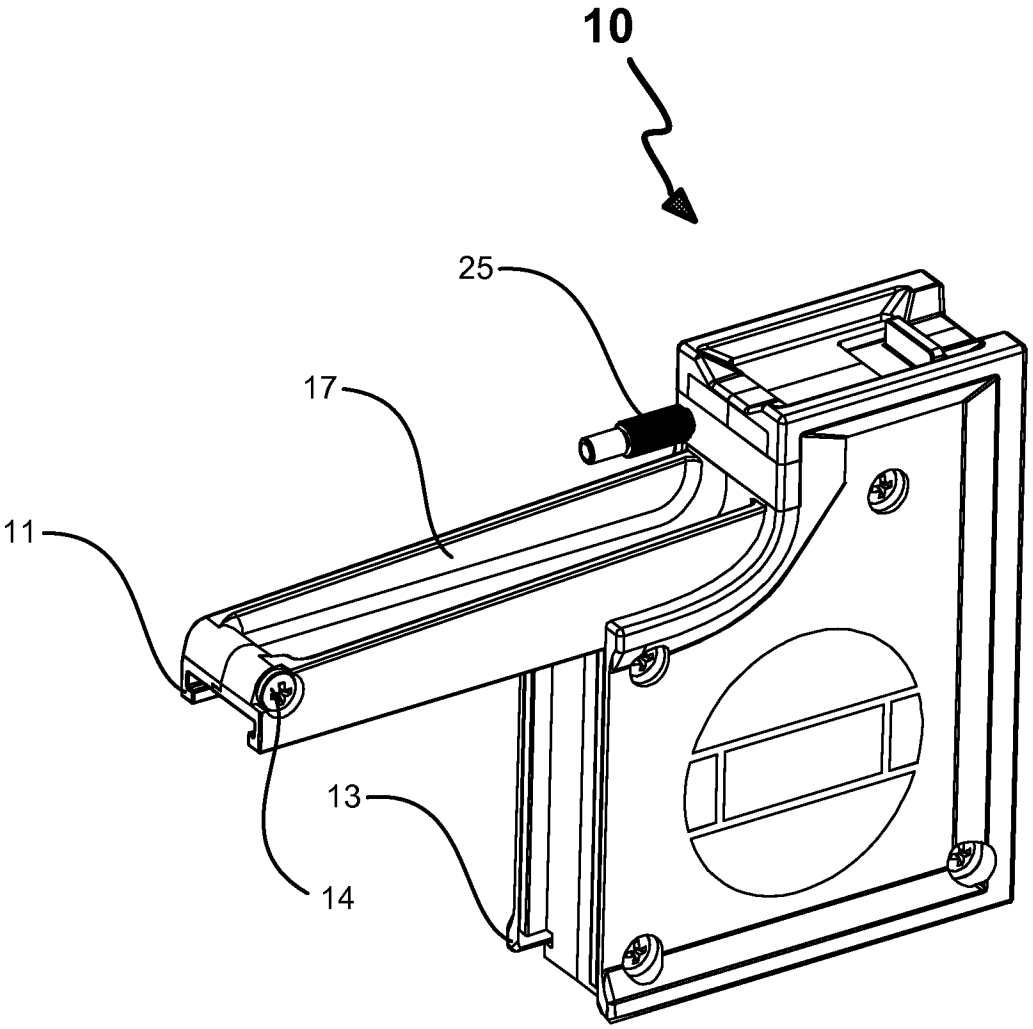
FIG. 1 is a side perspective view of a chamber portion of the line marking assembly according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

The present invention comprises of two separate and substantially closed chambers. Each chamber contains a spool onto which a cord is wound. The front end of the cord is configured to exit through an opening in each chamber directed through a conduit. The chamber has two side walls that are attached to each other: an outer side wall and an inside wall screwed onto the outer side wall. The opening and conduit for the cord is located at the outer wall such that the cord is in close proximity to the outer part of the chamber.

The cord in each chamber is configured for winding onto a corresponding spool from the inner end of the cord. Each spool is equipped with a tensioning spring coil and take-up drum assembly, a device known in the art for applying a constant and continuous pull tension onto the line.

A coupling member is attached to the end portion of each cord that is configured to exit its corresponding chamber. The two coupling members are configured to attach to each other to form an assembled coupler and a combined cord. The coupling may be accomplished by various arrangements such as knots, lanyards, rings, fusing and adhesives.

Each chamber contains a marking powder which may be chalk based or ink dye based. A covered opening at the bottom of each chamber is provided for filling the chamber with the marking powder.

Each chamber is configured for mounting onto one side of a level using a bracket attached to each side of the level and matching clips on the chambers adapted to clip onto the bracket. It is noted however that other attaching means such as screws, nails and adhesive also fall within the scope of the present invention. The mounting of the chambers onto the level is done such that the fronts of the chambers face each other over the sides of the level, such that the two coupling members likewise face each other and such that the outer side wall of each chamber coincides with the front side of the level.

The chambers mounted on the level form the line marking assembly. When the line marking assembly is not in use, the cords may be substantially contained within their respective chambers. To make the line marking assembly use ready, the coupling member attached to one of the cords is pulled along with its corresponding cord toward the coupling member attached to the cord of the of the other chamber and is then attached to it. In the course of pulling the first coupling member, the corresponding cord is coated by the marking powder contained within the chamber. In this position, the first cord will be in an outstretched position while the second cord will largely reside in the second chamber.

An essential feature of the present invention is a properly calibrated balance of pulling forces on the combines cord. Both cords are subjected to pull tension exerted by their respective tensioning members in the two chambers. Thus, if the assembled coupler that is formed after the first coupling member and second coupling member are joined is moved by hand from one chamber toward the other, the coupler will stay in the location where it is placed and not move by itself as a result of the pull by the tensioning assembly in one chamber overcoming that in the other.

To use the line marking assembly installed onto the level, the cord in the first chamber is outstretched by hand grasping and moving the coupler from one of the chambers to the other. This action applies a marking powder coating onto this cord. The assembly is then placed with the outer side walls of the chambers and the front of the level onto the surface to be marked. This places the cord in close proximity with the surface. The cord would be aligned with the line on the surface that requires cutting. The cord is then pulled up by hand away from the surface and against the resistance of the tensioning members in the chambers and released. The release of the cord causes the tensioning members of the two chambers to pull the cord back and snap it onto the surface which in turn releases the marking powder to mark the surface.

Figure 2:
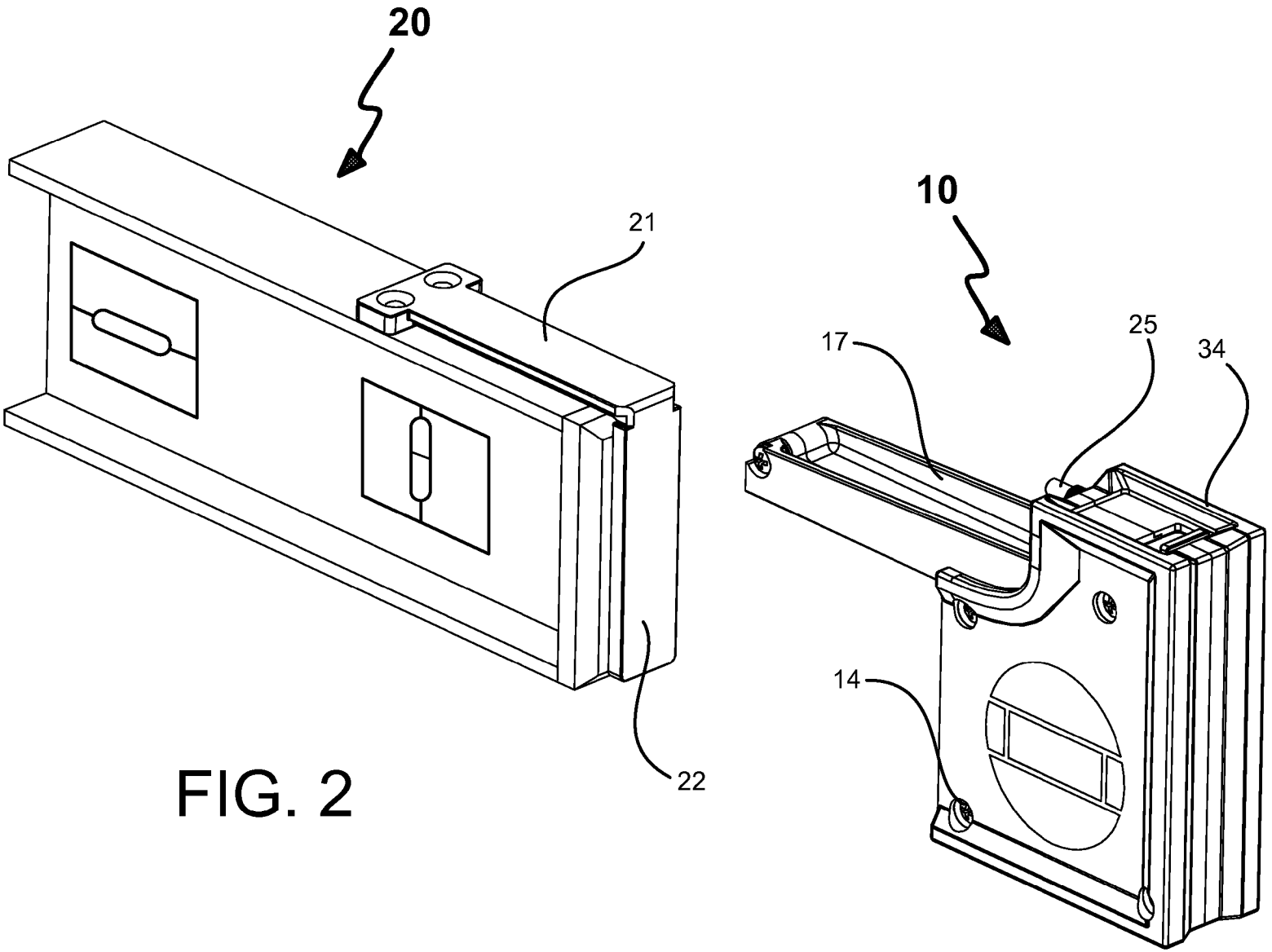
FIG. 2 is a rear side perspective view of the chamber portion of the line marking assembly in position for mounting onto a side of a level according to an embodiment of the present invention.
Figure 3:
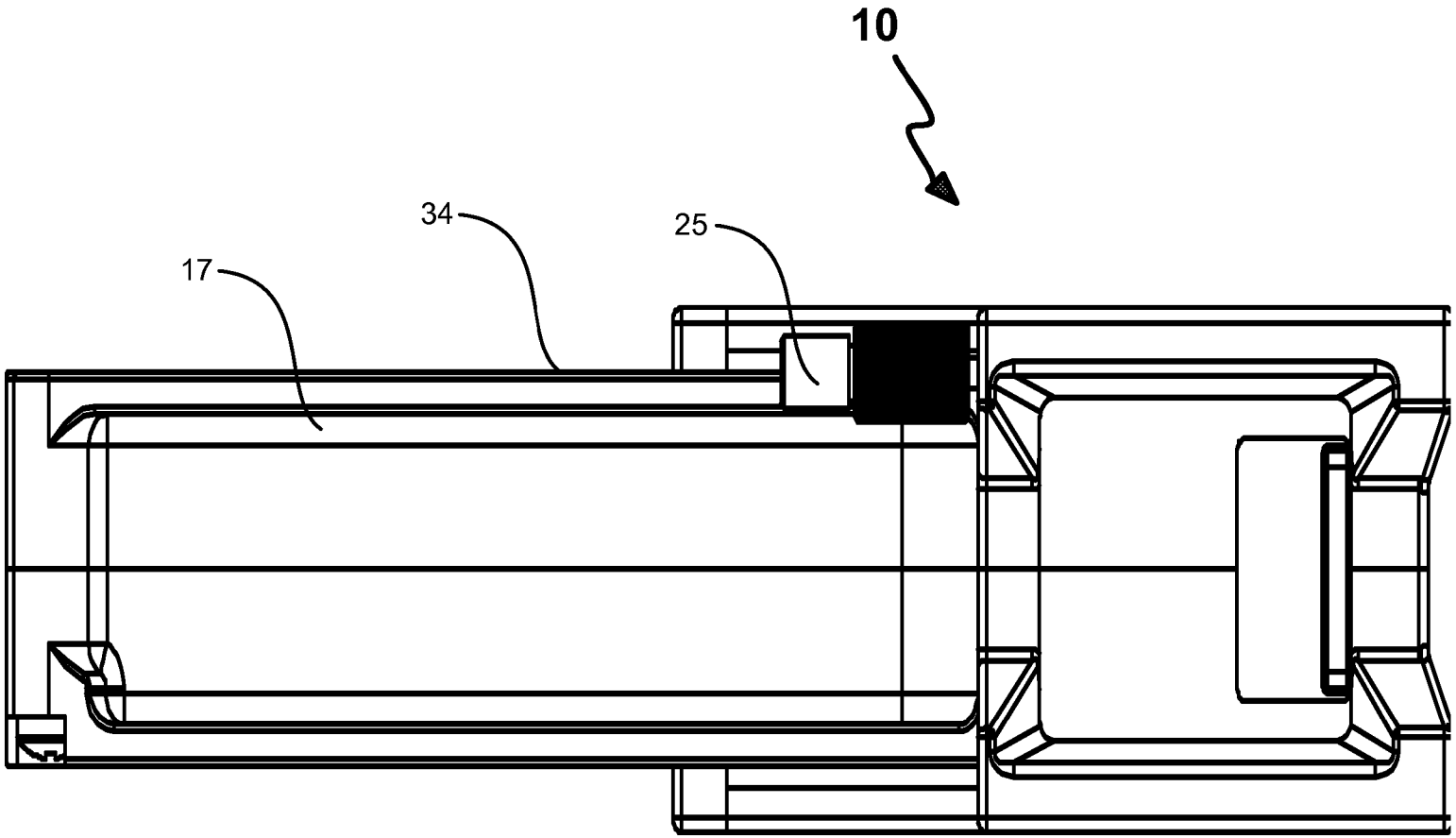
FIG. 3 is a top view of the chamber portion of the line marking assembly according to an embodiment of the present invention.
Figure 4:
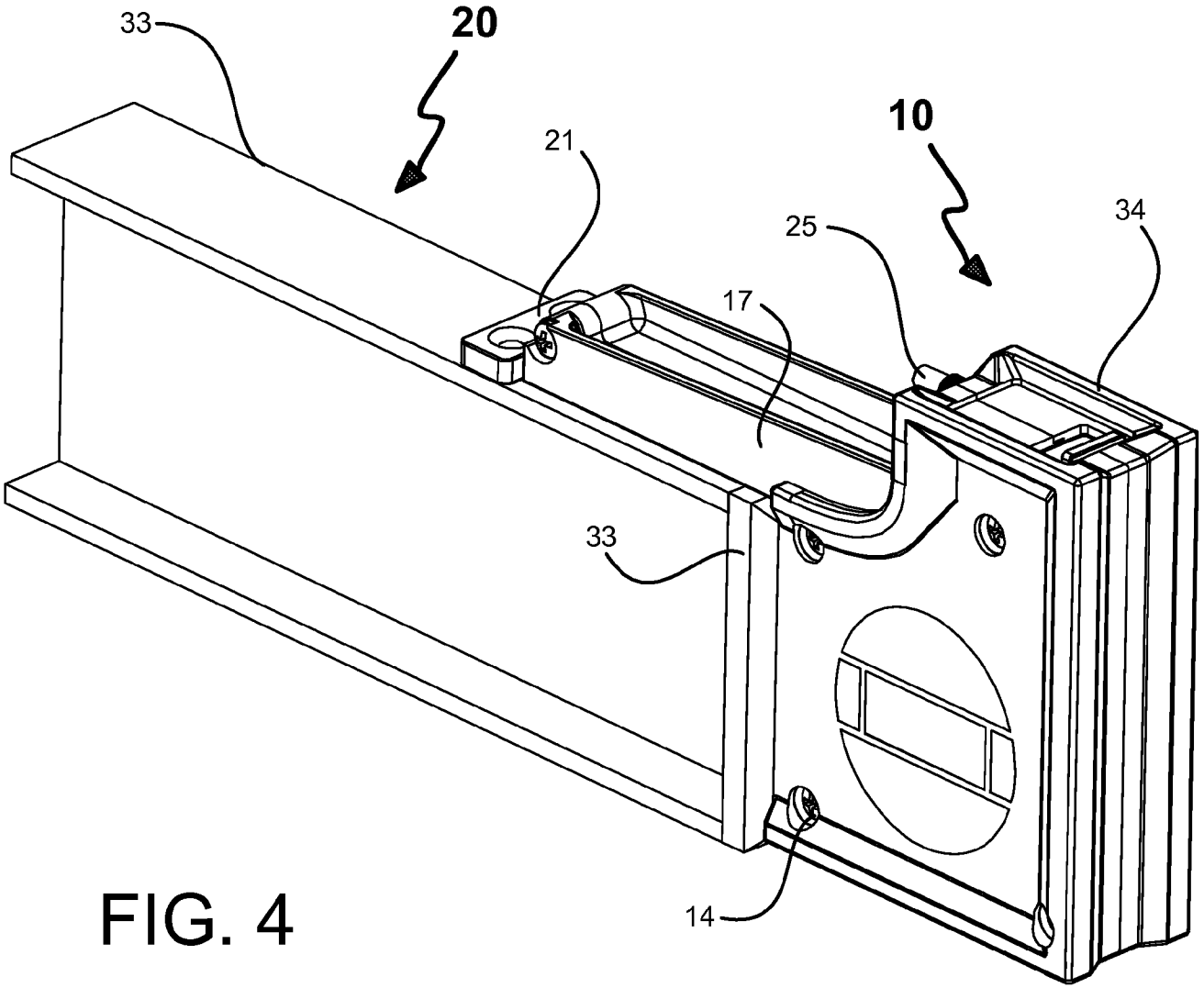
FIG. 4 is a rear side perspective view of the chamber portion of the line marking assembly mounted onto a side of a level according to an embodiment of the present invention.
Figure 5:
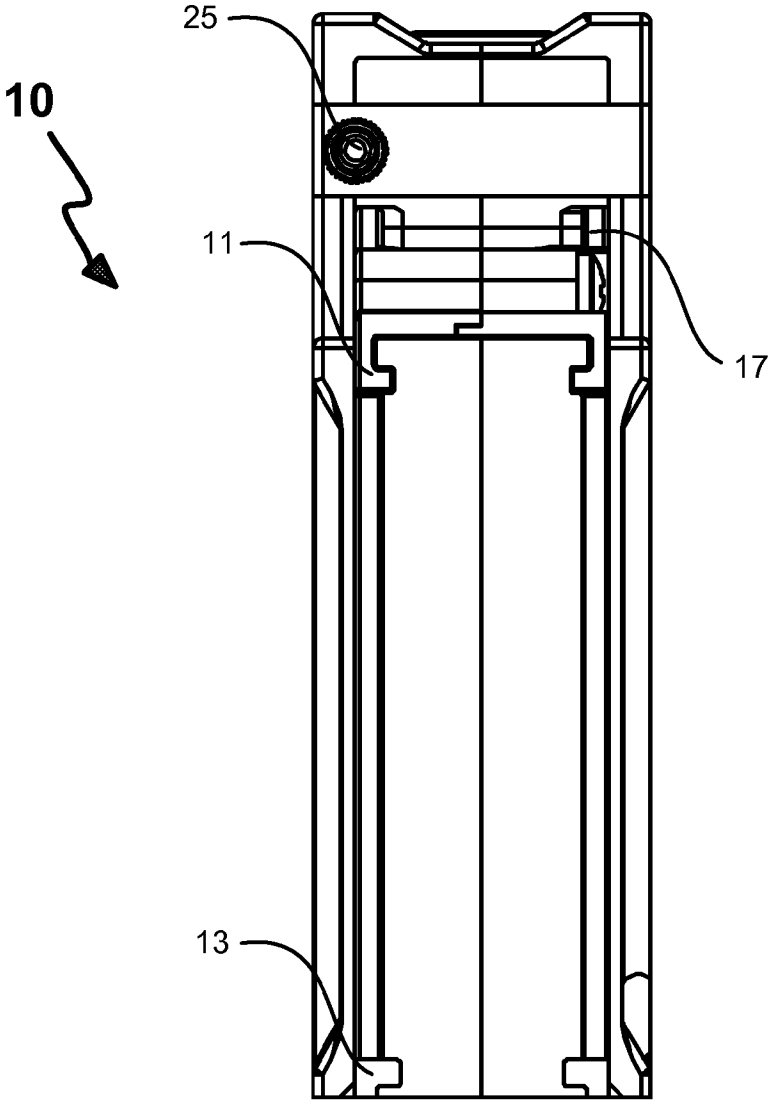
FIG. 5 is a front view of the chamber portion of the line marking assembly according to an embodiment of the present invention.
Figure 6:
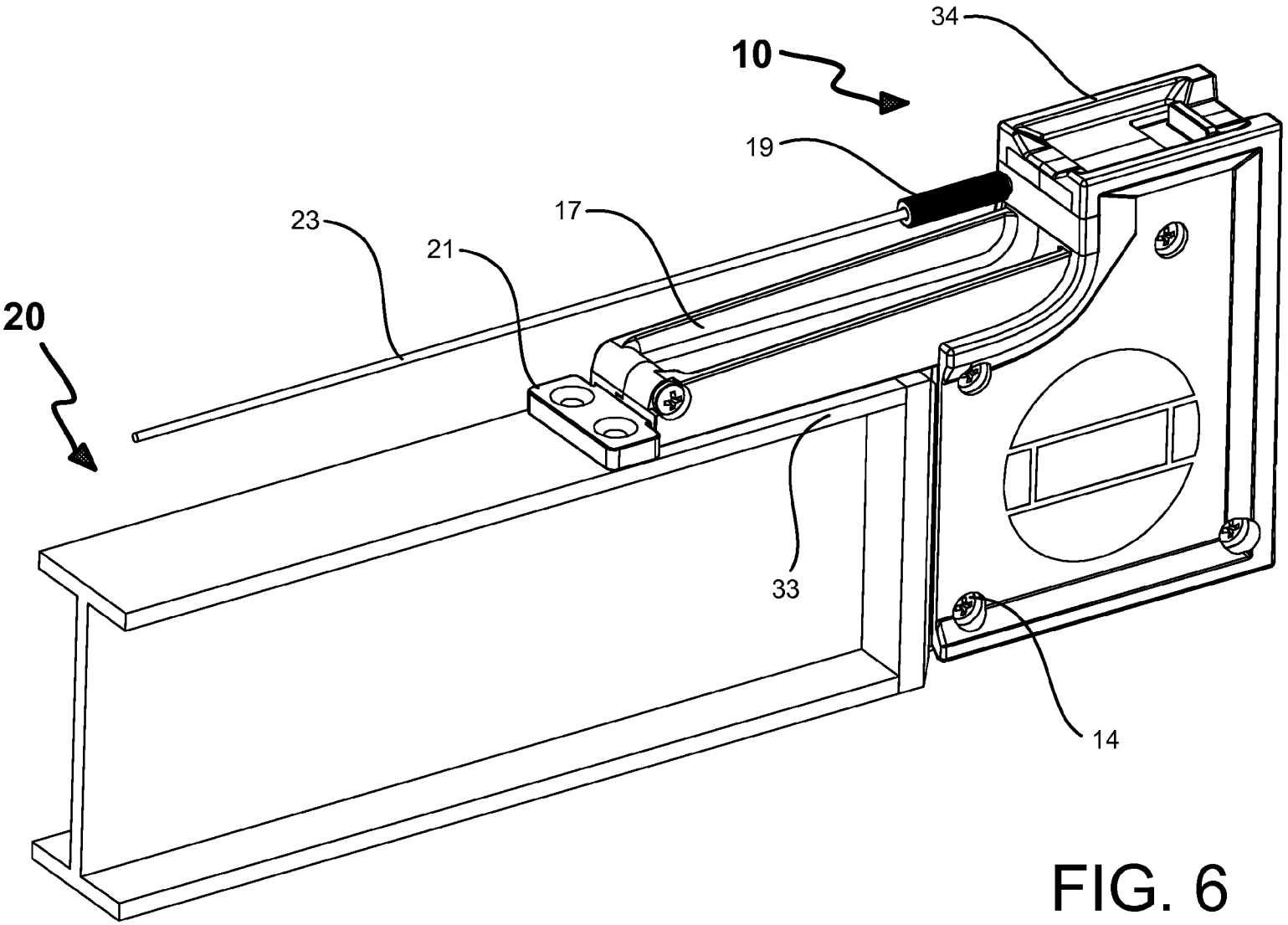
FIG. 6 is a front side perspective view of a chamber portion of the line marking assembly mounted onto a side of a level according to an embodiment of the present invention.
Figure 7:
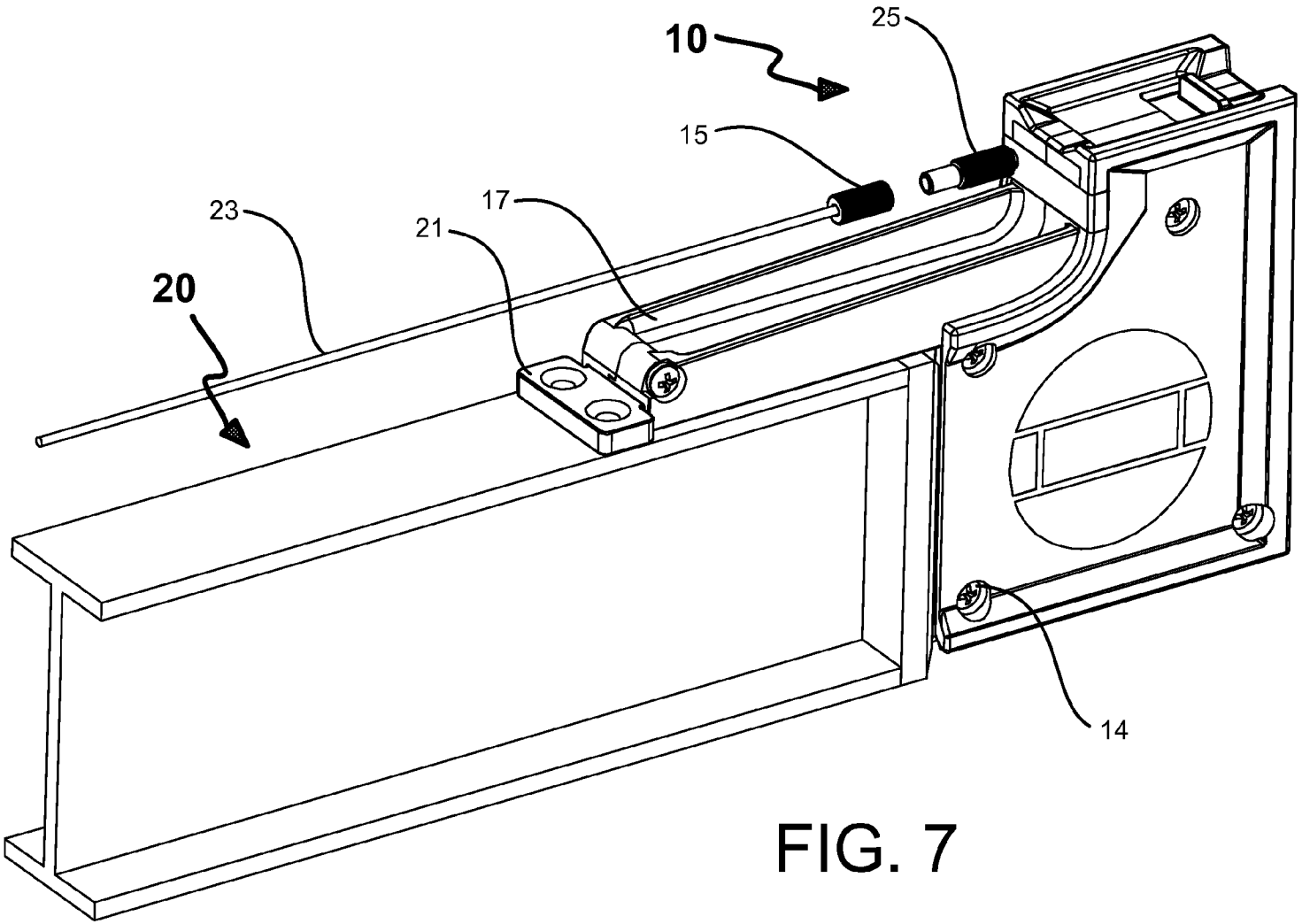
FIG. 7 is another front side perspective view of a chamber portion of the line marking assembly mounted onto a side of a level according to an embodiment of the present invention.
Figure 8:
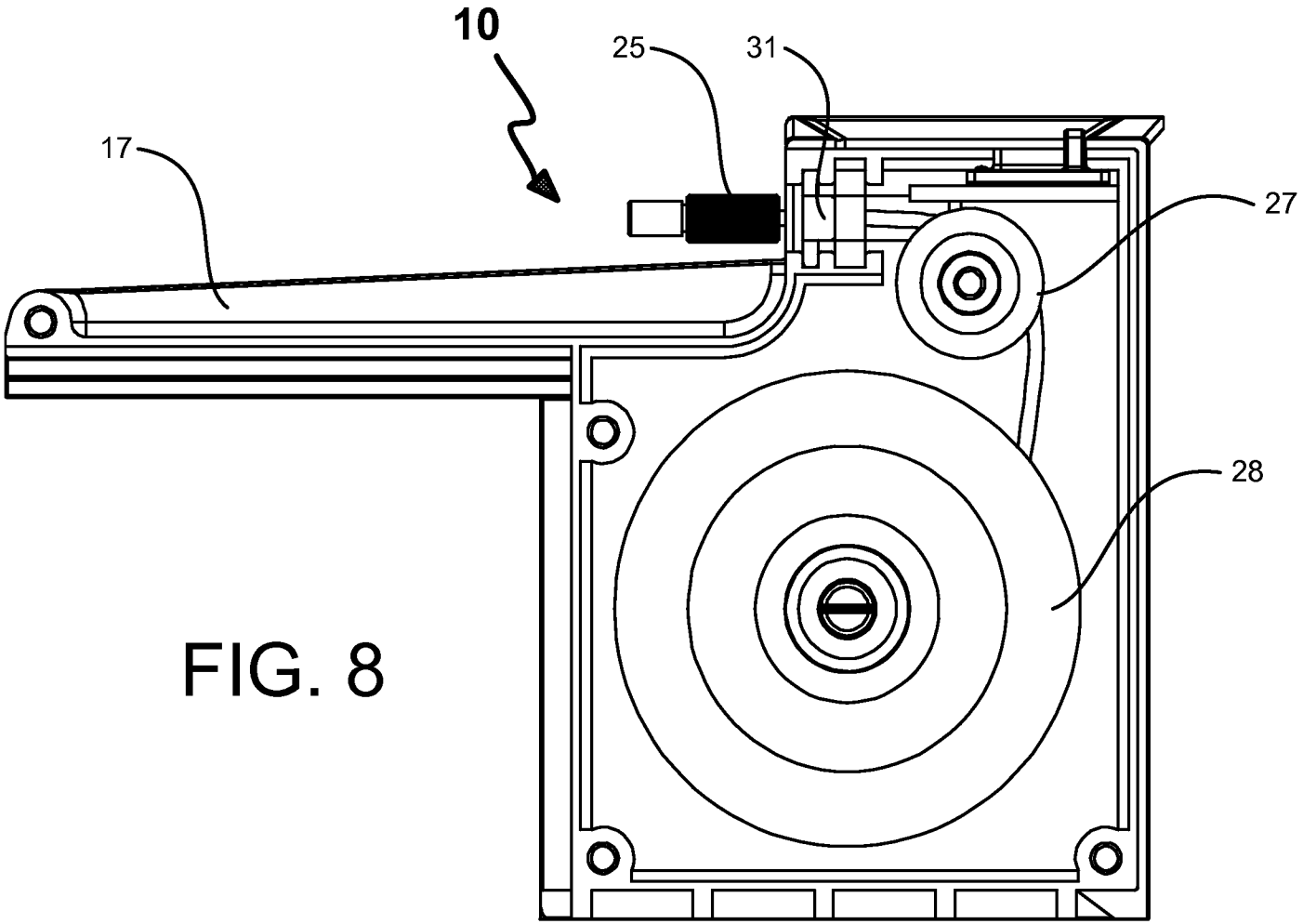
FIG. 8 is a side cross sectional view of a chamber portion of the line marking assembly according to an embodiment of the present invention.
Figure 9:
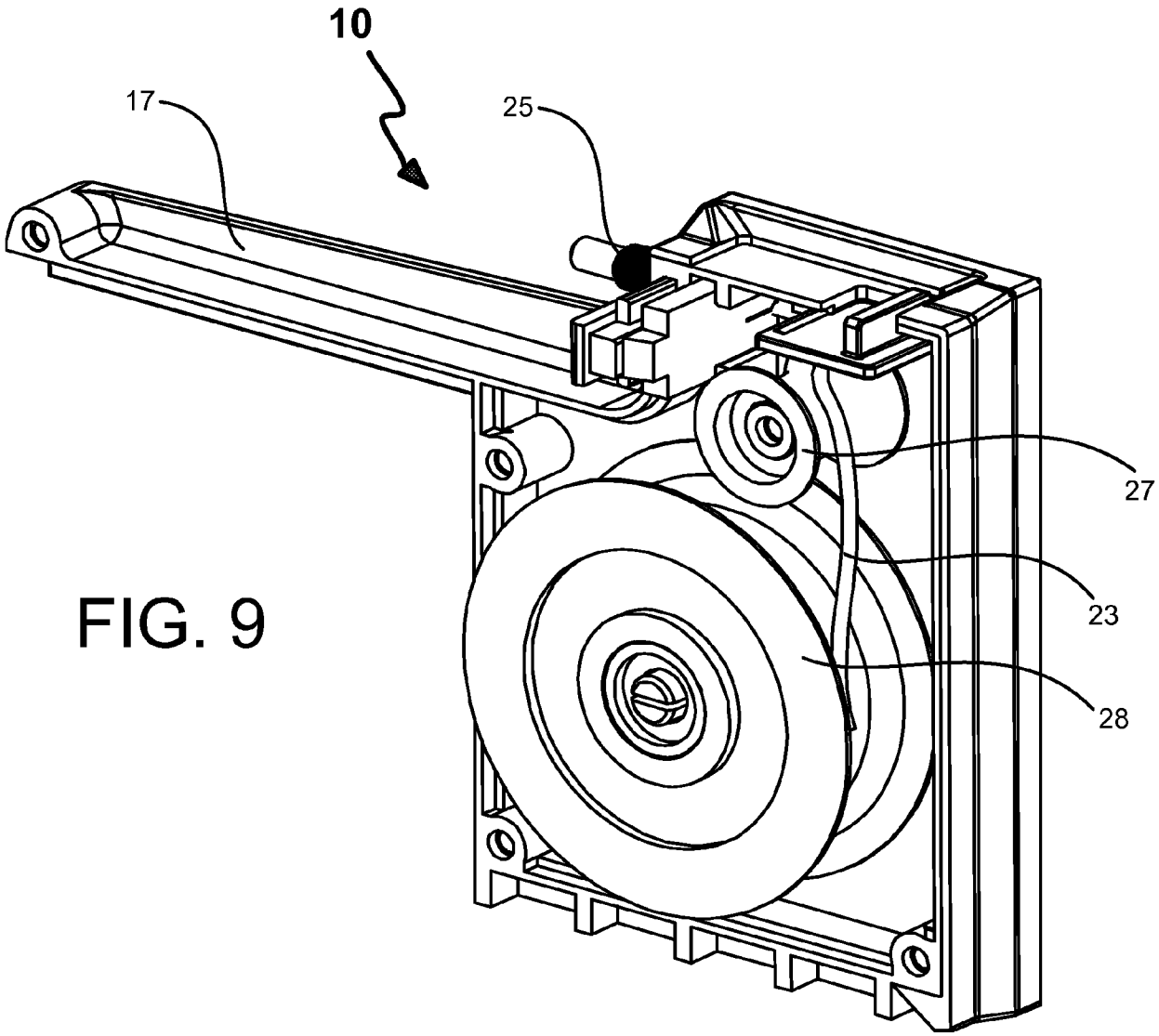
FIG. 9 is a rear side cross sectional perspective view of a chamber portion of the line marking assembly according to an embodiment of the present invention.
Figure 10:
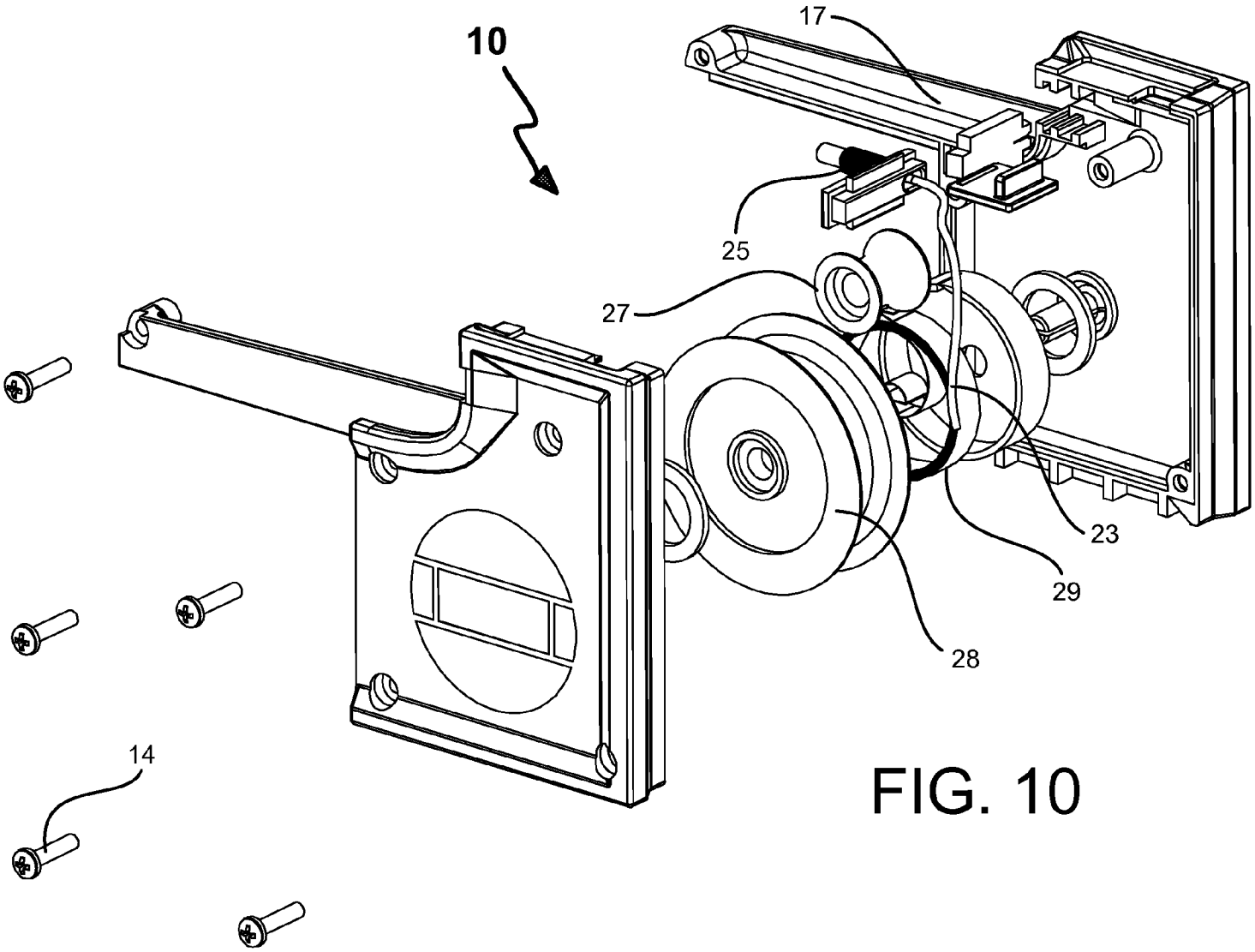
FIG. 10 is an exploded side perspective view of a chamber portion of the line marking assembly according to an embodiment of the present invention.
Figure 11:
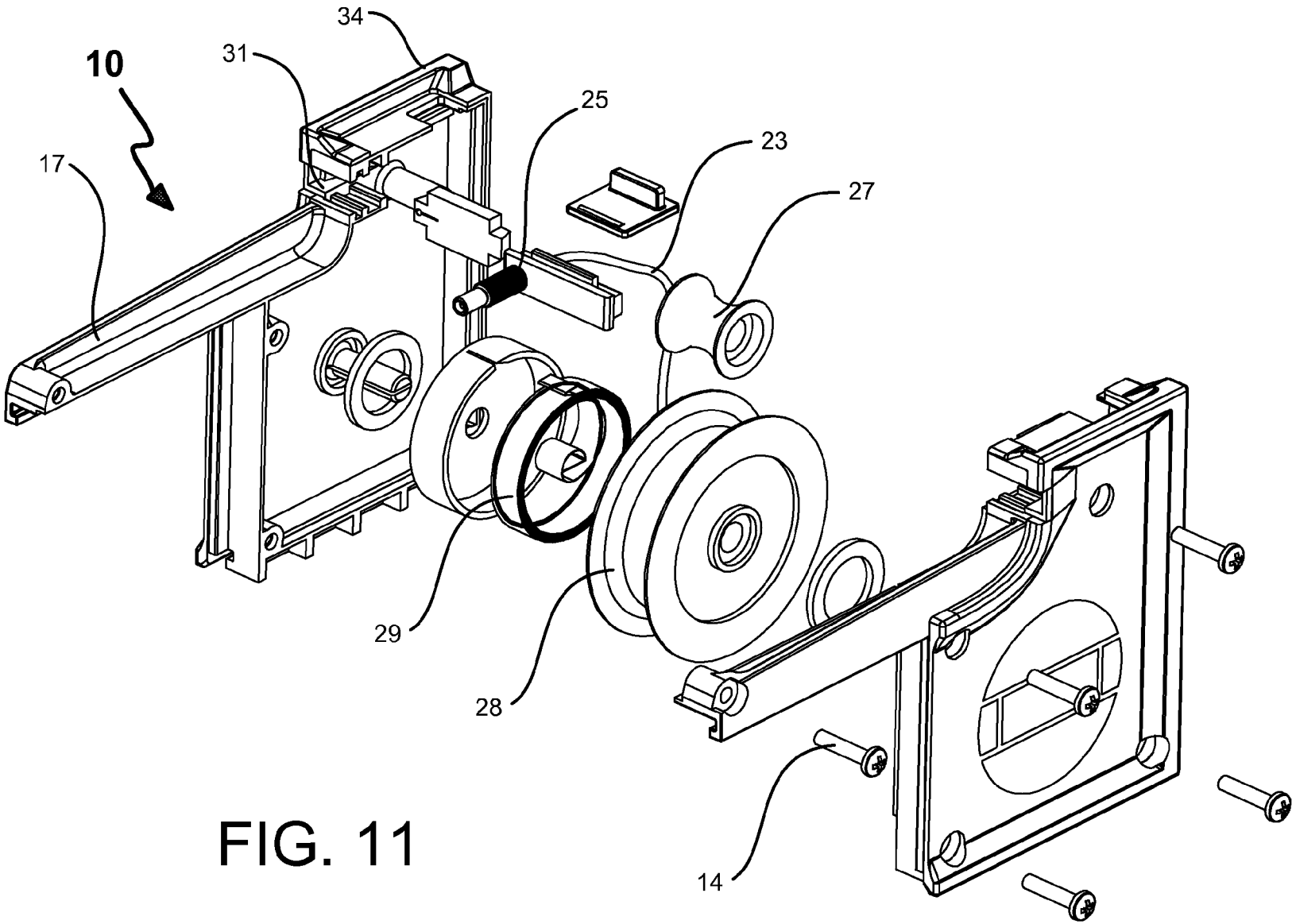
FIG. 11 is another exploded side perspective view of a chamber portion of the line marking assembly according to an embodiment of the present invention.

The present invention is illustrated in FIGS. 1-17. A chamber 10 has a lateral mounting extension 17 that comprises a lateral mounting clip 11 for attaching onto the top surface of a level. Vertical clip 13 is used for attaching onto the side of the level 20. The housing of the chamber 10 contains two parts attached together by screws 14. The lateral mounting clip 11 is adapted to fasten onto lateral bracket 21 attached to the top side of the level 20 while vertical clip 13 is adapted to fasten onto vertical bracket 22 attached to the side of the level as shown in FIGS. 2 and 4. The chamber 10 shown in FIGS. 1-11 has a male coupling member 15. The chamber on the opposite side of the level 20 (not shown) has a female coupling member 25 as shown in FIG. 7. The assembled coupler 19 is shown in FIG. 6. In the assembled form, the cord 23 traverses the length of the level 20 from the second chamber to the first chamber 10 and is maintained under tension by the tensioning member of the second chamber (not shown in FIG. 6 or 7). Each chamber has a guiding reel 27 that guides the cord 23 onto the winding reel 28. The tensioning member comprises of a spring coil 29 and a take up drum 26 as shown in FIGS. 10 and 11.

A cord 23 is directed to exit either chamber (10 or 10A) through a conduit 31 disposed at the outer part 34 as shown for chamber 10 and 34A for chamber 10A. When mounted onto the level 20, the cord 23 is disposed above the front side 33 of the level 20.

Figure 12:
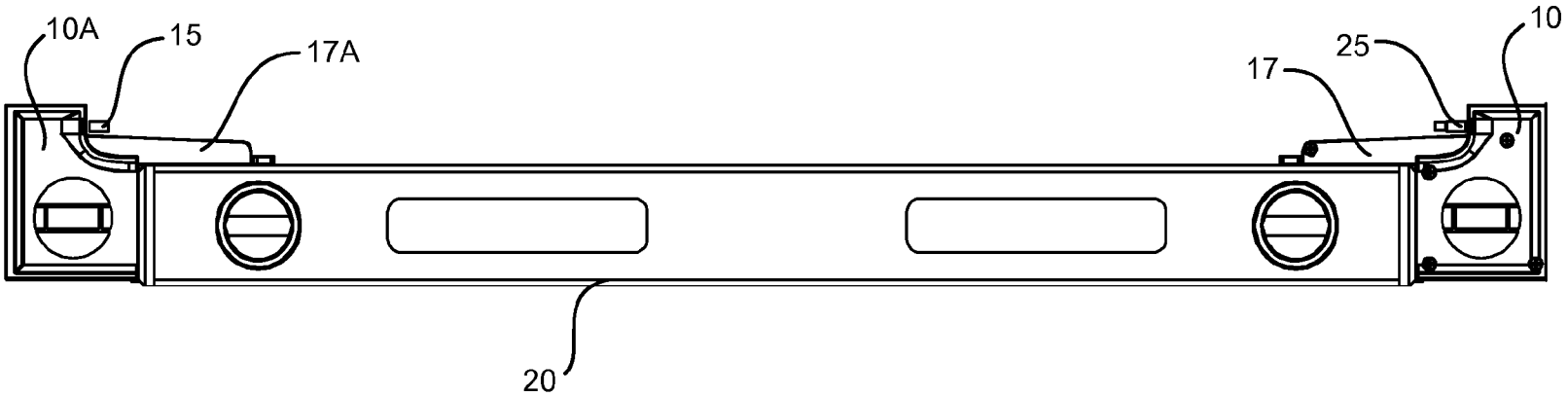
FIG. 12 shows the two chambers mounted on a level that form the line marking assembly according to an embodiment of the present invention.

FIGS. 12-17 illustrate embodiments for using the line marking assembly. FIG. 12 shows chamber 10 and 10A mounted on a level 20. The first coupling member 15 is disposed at chamber 10, while the second coupling member 25 is disposed at chamber 10A. The second chamber 10A shown in FIGS. 12-17 is identical to chamber 10 except that it contains a male coupling member 15.

Figure 13:
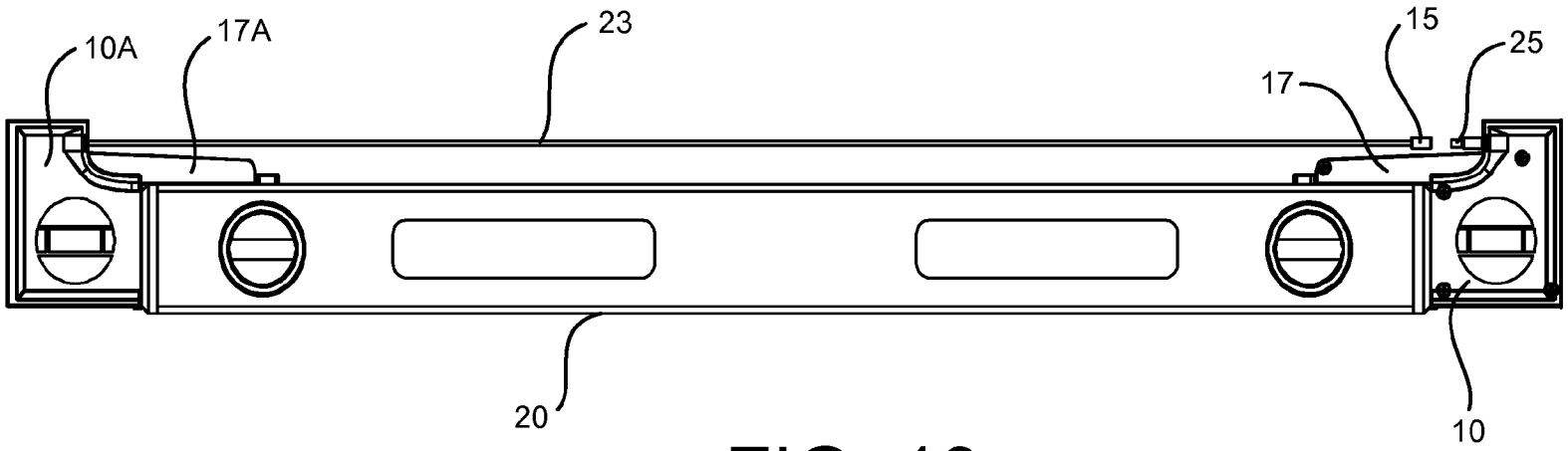
FIG. 13 depicts the method step of coating the first chamber cord with marking powder according to an embodiment of the present invention.
Figure 14:
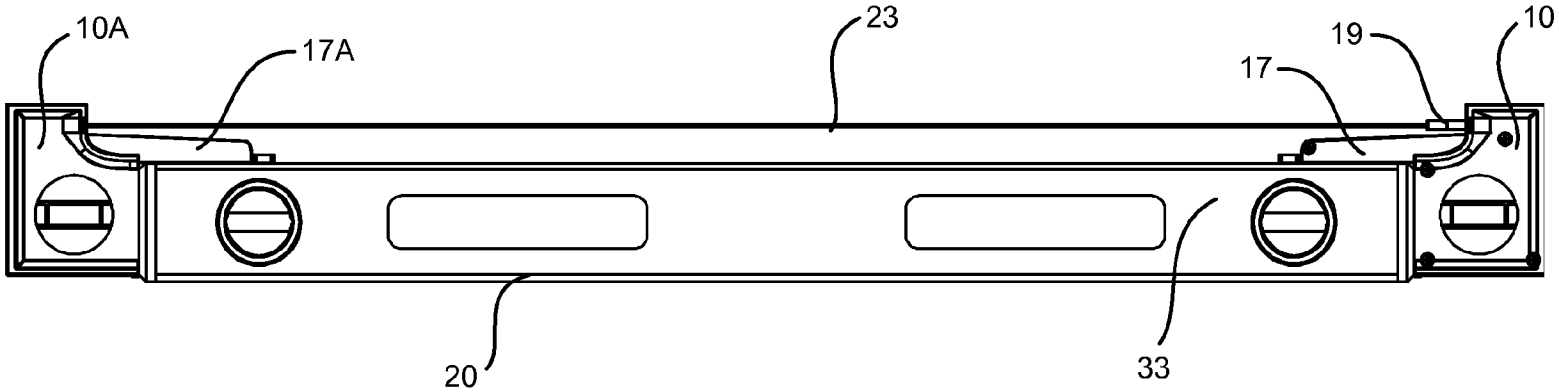
FIG. 14 shows the method step of forming the coupler according to an embodiment of the present invention.
Figure 15:
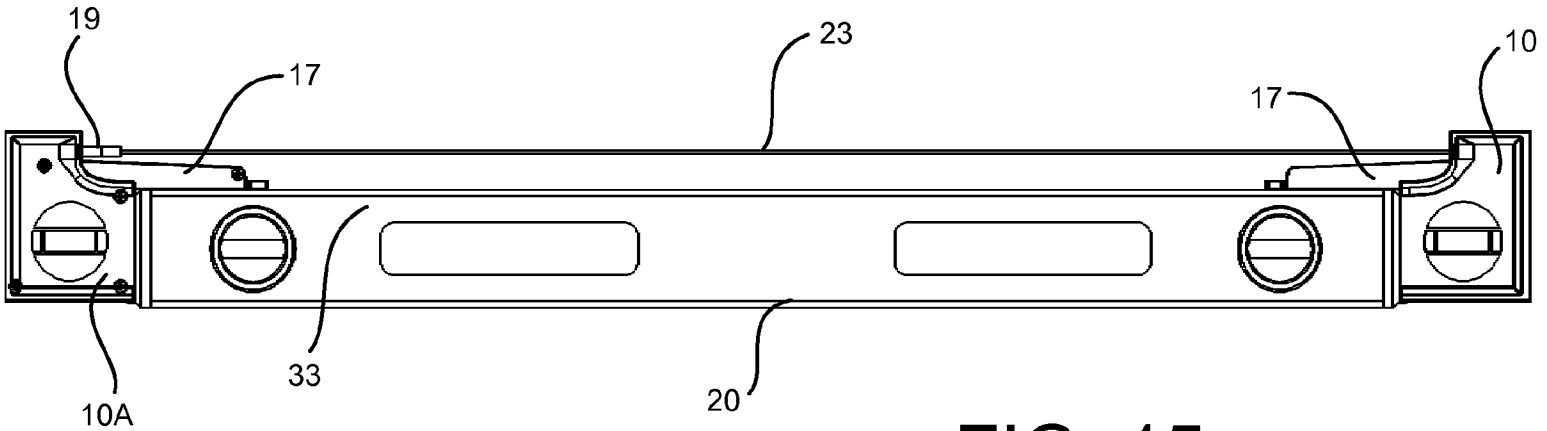
FIG. 15 illustrates the step of coating the cord located in the second chamber according to an embodiment of the present invention.
Figure 16:
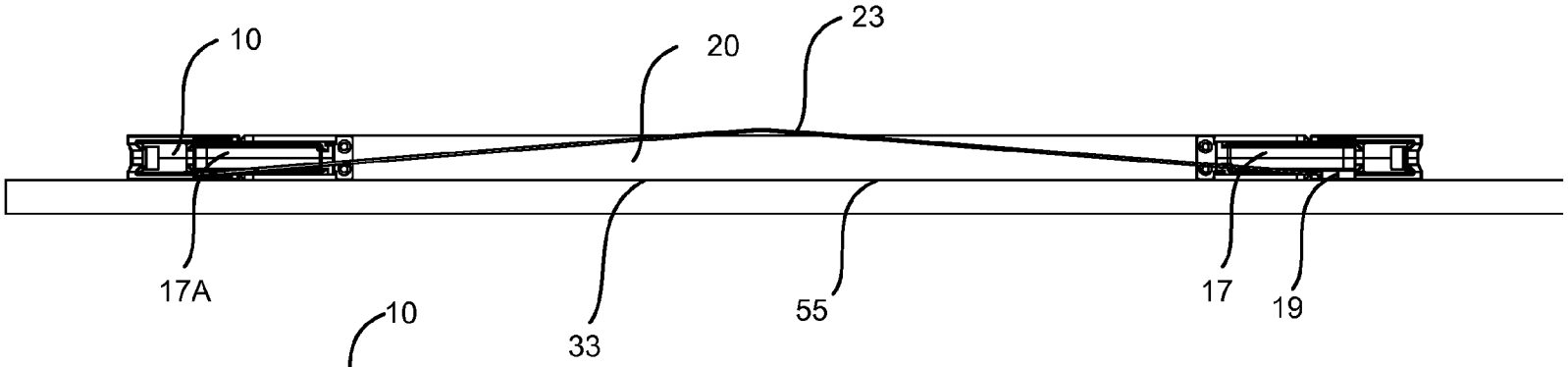
FIGS. 16 and 16A are depictions of the method of marking a straight line on a surface according to an embodiment of the present invention.
Figure 16A:
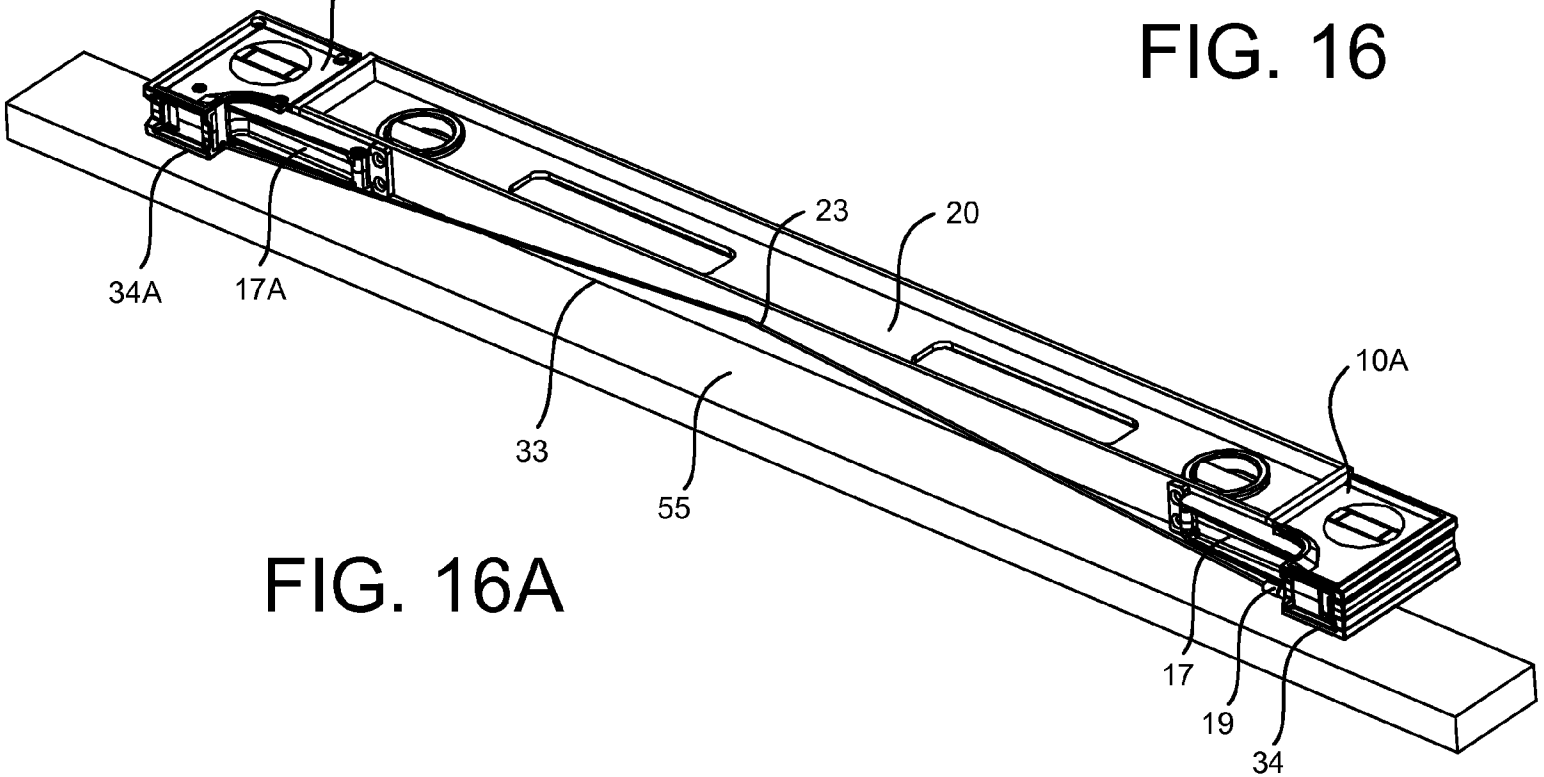

In FIG. 13, the first coupling member 15 is pulled toward the second coupling member 25, while in FIG. 14 the first coupling member 15 is attached to the second coupling member 25 to form the assembled coupler 19. This action also coats the cord 23 housed in the first chamber with marking powder. If the marking powder wears off the cord 23 after one or more uses, the cord 23A from chamber 10A is coated with powder by moving the coupler 19 from chamber 10A back to chamber 10 as shown in FIG. 15. FIGS. 16 and 16A depict two views of the step of marking a line on surface 55. The front side of the marking line assembly level is placed flush against the surface 55. The cord 23 is pulled upward against the resistance of the tensioning assemblies inside the two chambers 10 and 10A and released. The cord 23 rebounds and the rebound momentum causes the cord to snap onto the surface 55 and release the marking powder in a straight line onto the surface 55.

Figure 17:
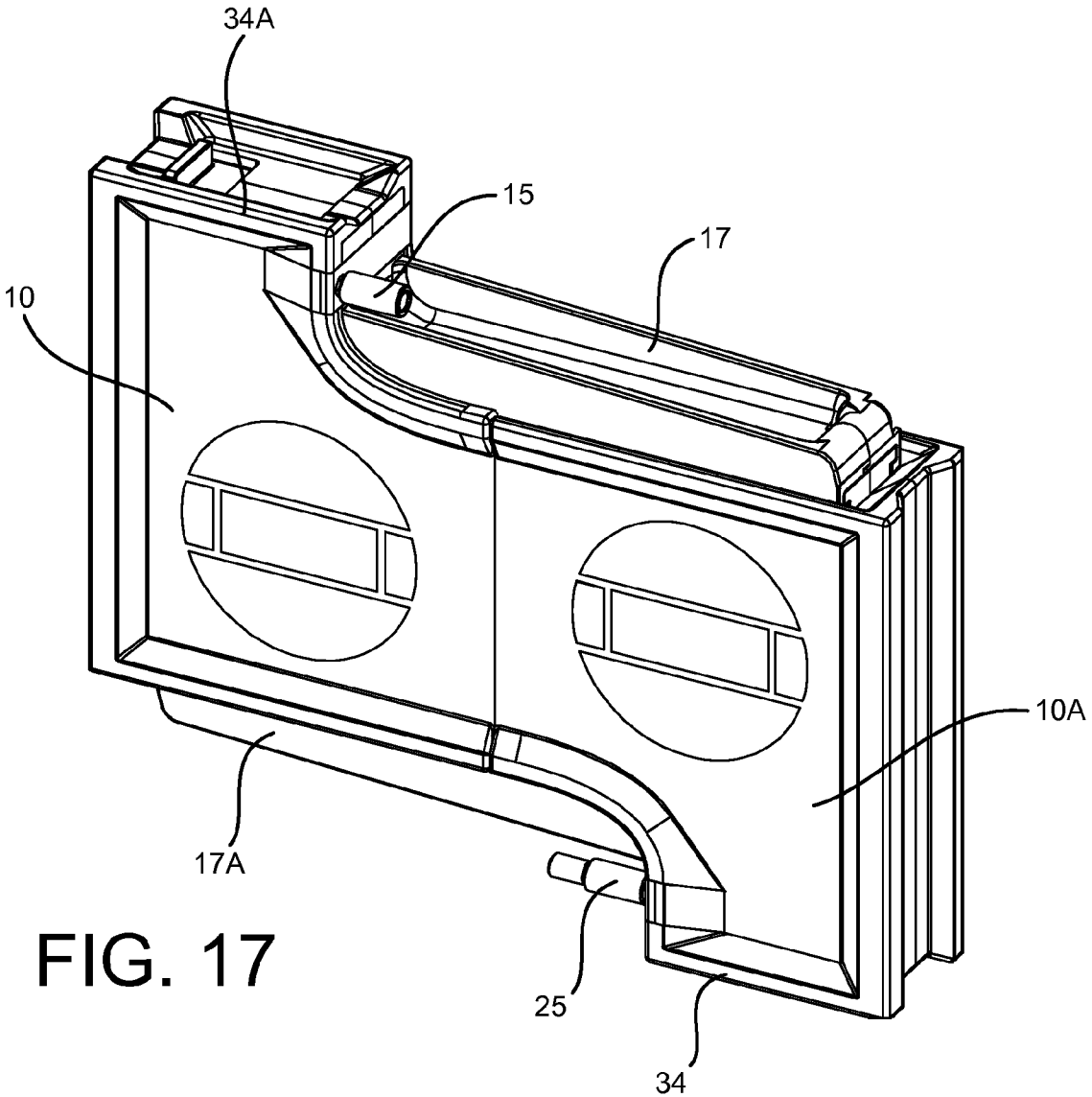
FIG. 17 shows two chambers attached to each other according to an embodiment of the present invention.

FIG. 17 shows an embodiment for attaching one chamber 10 onto the other chamber 10A for storage purposes. Each lateral mounting clip disposed on the bottoms of extensions 17 and 17A of chambers 10 and 10A respectively clip onto the bottom of the opposing chamber.

It is noted that each chamber may be used in a free standing form for marking a line in an unattached position to the level. It is also noted that various sizes of the line marking assembly fall within the scope of the present invention. Thus, the lengths of the corresponding line marking segments wound on the spools and the lengths of the exposed line marking sections vary in length as well.

It should be understood, of course, that the foregoing relates to exemplary embodiments of the invention and that modifications may be made without departing from the spirit and scope of the invention.

We claim:

1. A line marking assembly configured for mounting onto a level comprising:

a first chamber containing a spool for winding a first cord, said spool contained in the first chamber comprising a tensioning member, wherein an end of the first cord is configured for exiting the first chamber through a first conduit disposed at an outer front side of the first chamber;

a second chamber containing a spool for winding a second cord, said spool contained in the second chamber comprising a tensioning member, wherein an end of the second cord is configured for exiting the second chamber through a second conduit disposed at an outer front side of the second chamber, said first chamber containing a marking powder and said second chamber containing a marking powder;

a first coupling member attached to the end of the first cord, said first cord being outside the first chamber; and a second coupling member attached to the end of the second cord, said second cord being outside the second chamber, said first coupling member being configured for attaching to the second coupling member to form an assembled coupler and a combined cord.

2. The line marking assembly of claim 1 wherein the tensioning member contained in the first chamber is a spring coil and take-up drum assembly configured for exerting a constant and continuous pull on the first cord when said first cord is in an outstretched position.

3. The line marking assembly of claim 1 wherein the tensioning member contained in the second chamber is a spring coil and take-up drum assembly configured for exerting a constant and continuous pull on the second cord when said second cord is in an outstretched position.

4. The line marking assembly of claim 1 further comprising attaching means configured for mounting the first chamber onto a first side of the level.

5. The line marking assembly of claim 4 further comprising attaching means configured for mounting the second chamber on a second side of the level in a manner such that the front side of the second chamber is disposed in a position that is a mirror image of the front side of the first chamber and that the combined cord is offset from a center of the level to a front side of the level, said combined cord being disposed directly over and substantially parallel with a first side edge of the level in such a manner that a tension exerted onto said combined cord by the tensioning member contained in the first chamber and the tensioning member contained in the second chamber substantially balance out.

6. The line marking assembly of claim 5 wherein the attaching means configured for mounting the first chamber onto a first side of the level comprise a lateral mounting extension extending from the front side of the first chamber, said lateral mounting extension being configured to clip onto a lateral bracket attached to a top of the first side of the level, said attaching means also comprising a vertical clip attached to the front side of the first chamber said vertical clip being adapted to clip onto a vertical bracket attached to the first side of the level.

7. The line marking assembly of claim 6 wherein the attaching means configured for mounting the second chamber on a second side of the level comprise a lateral mounting extension extending from the front side of the second chamber, said lateral mounting extension extending from the front side of the second chamber, said lateral mounting extension being configured to clip onto a lateral bracket attached to a top of the second side of the level, said attaching means also comprising a vertical clip attached to the front side of the second chamber said vertical clip being adapted to clip onto a vertical bracket attached to the second side of the level.

8. The line marking assembly of claim 7 wherein the first chamber is configured for attaching to the second chamber by clipping the lateral mounting extension of the first chamber onto a grooved bar attached to a bottom of the second chamber and by clipping the lateral mounting extension of the second chamber onto a grooved bar attached to a bottom of the first chamber.

9. The line marking assembly of claim 1 wherein the marking powder consists of a chalk based powder.

10. The line marking assembly of claim 1 wherein the marking powder consists of an ink based powder.

11. A method for applying a straight line mark on a surface, said method comprising:

providing a line marking assembly configured for mounting onto a level, said level having a front, a first side and a second side, said line marking assembly comprising: a first chamber containing a spool for winding a first cord, said spool contained in the first chamber comprising a tensioning member, wherein an end of the first cord is configured for exiting the first chamber through a first conduit disposed at a front side and at an outer side of the first chamber; a second chamber containing a spool for winding a second cord, said spool contained in the second chamber comprising a tensioning member, wherein an end of the second cord is configured for exiting the second chamber through a second conduit disposed at a front side and at an outer side of the second chamber, said first chamber containing a marking powder and said second chamber containing a marking powder; a first coupling member attached to the end of the first cord, said first cord being configured for exiting the first chamber; and a second coupling member attached to the end of the second cord, said second cord being configured for exiting the second chamber, said first coupling member being configured for attaching to the second coupling member to form an assembled coupler and a combined cord;

mounting the first chamber onto a first side of the level and mounting the second chamber on a second side of the level in a manner such that: the outer side of the first chamber is disposed over the front side of the level, the outer side of the second level is disposed over the front side of the level, the second chamber is disposed in a position that is a mirror image of the first chamber and the first and second coupling members are in an unstretched position;

coating the first cord with marking powder by pulling the first coupling member and the end of the first cord that are disposed at the first chamber toward the second coupling member that is disposed at the second chamber;

attaching said first coupling member to the second coupling member to form an assembled coupler such that an outstretched cord resulting from attaching the first and second cord is offset from a center of the level and is disposed directly over and substantially parallel with a front side of the level to form an installed line marking assembly;

placing the front side of the level onto the surface to be marked such that the cord is parallel and adjacent to the line on the surface to be marked; and pulling the cord upward and releasing it onto the surface, said releasing the cord resulting in snapping the outstretched cord onto the surface thereby releasing a portion of the marking powder and forming a straight line mark on said surface.

12. The method of claim 10 further comprising recoating the cord for a subsequent use by moving the assembled coupler from the second chamber back toward the first chamber, wherein a source of the coating powder for recoating the cord is the second chamber.

* * * * *